US007383886B2

(12) United States Patent
Dybevik et al.

(10) Patent No.: US 7,383,886 B2
(45) Date of Patent: Jun. 10, 2008

(54) DEVICE AND A METHOD FOR SELECTIVE CONTROL OF FLUID FLOW BETWEEN A WELL AND SURROUNDING ROCKS

(75) Inventors: Arthur H. Dybevik, Sandnes (NO); Svein Kvernstuen, Sandnes (NO)

(73) Assignee: Reslink AS, Algard (NO)

( * ) Notice: Subject to any disclaimer, the term of this patent is extended or adjusted under 35 U.S.C. 154(b) by 118 days.

(21) Appl. No.: 10/561,721

(22) PCT Filed: Jun. 15, 2004

(86) PCT No.: PCT/NO2004/000175

§ 371 (c)(1),
(2), (4) Date: May 26, 2006

(87) PCT Pub. No.: WO2004/113671

PCT Pub. Date: Dec. 29, 2004

(65) Prior Publication Data

US 2006/0266524 A1 Nov. 30, 2006

(30) Foreign Application Priority Data

Jun. 25, 2003 (NO) ..... 20032916

(51) Int. Cl.
*E21B 43/08* (2006.01)
*E21B 43/12* (2006.01)

(52) U.S. Cl. ..... 166/369; 166/227; 166/296

(58) Field of Classification Search ..... 166/227, 166/369, 296
See application file for complete search history.

(56) References Cited

U.S. PATENT DOCUMENTS

| | | | | |
|---|---|---|---|---|
| 4,018,283 | A * | 4/1977 | Watkins | 166/278 |
| 5,355,956 | A | 10/1994 | Restarick | |
| 5,881,809 | A | 3/1999 | Gillespie et al. | |
| 6,116,343 | A | 9/2000 | Van Petegem et al. | |
| 6,857,476 | B2 * | 2/2005 | Richards | 166/278 |
| 7,296,633 | B2 * | 11/2007 | Bode et al. | 166/386 |
| 2004/0020832 | A1 * | 2/2004 | Richards et al. | 210/106 |
| 2004/0144544 | A1 * | 7/2004 | Freyer | 166/369 |

FOREIGN PATENT DOCUMENTS

| | | |
|---|---|---|
| NO | B1 314701 | 5/2003 |
| WO | WO 03/023185 | 3/2003 |

* cited by examiner

*Primary Examiner*—Hoang Dang
(74) *Attorney, Agent, or Firm*—Peter T. Holsen; Bryan P. Galloway; Tim Curington

(57) ABSTRACT

A device and a method for selective control of fluid flow between a flow pipe (14) of a well and surrounding rocks (12). The flow pipe (14) is provided with at least one flow-through particle filter (16) placed externally on the flow pipe (14) and between the flow pipe (14) and the rocks (12). The filter (16) is connected in a flow-through manner to the flow pipe (14) via a flow channel (38). The characteristic of the invention is that the flow pipe (14) is provided with an imperforated pipe wall inside of and vis-a-vis said flow channel (38) when installing the flow pipe (14) in the well. Then the flow pipe (14) may be perforated selectively inside of the flow channel (38) for one or several filters (16) along the flow pipe (14), whereupon fluids may flow through the flow channel (38) and the filter (16) via perforation apertures (54) in the flow pipe (14).

10 Claims, 2 Drawing Sheets

Figure 1:
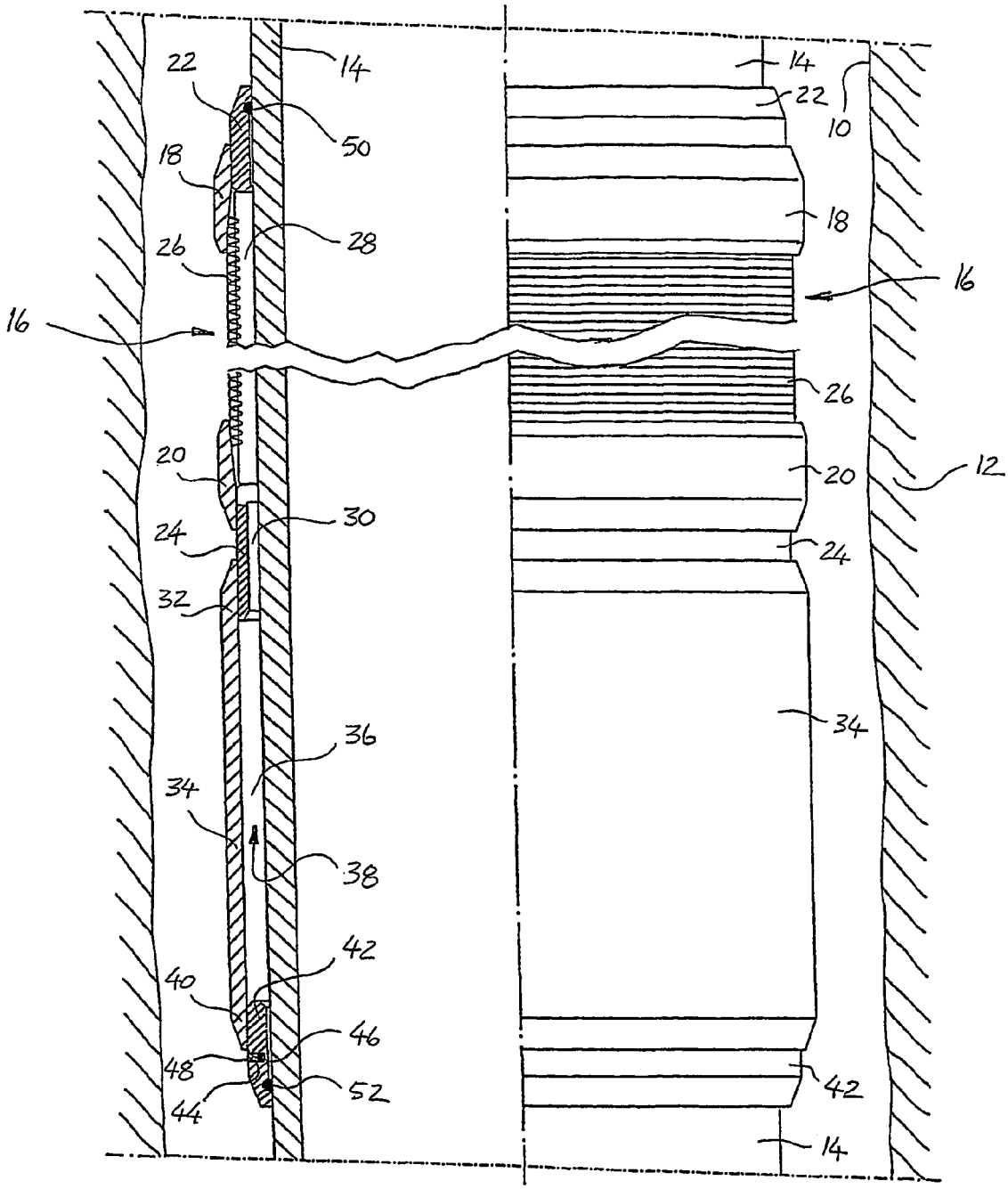

DEVICE AND A METHOD FOR SELECTIVE CONTROL OF FLUID FLOW BETWEEN A WELL AND SURROUNDING ROCKS

CROSS REFERENCE TO RELATED APPLICATION

The present application is the U.S. national stage application of International Application PCT/NO2004/000175, filed Jun. 15, 2004, which international application was published on Dec. 29, 2004 as International Publication WO 2004/113671. The International Application claims priority of Norwegian Patent Application 20032916, filed Jun. 25, 2003.

FIELD OF INVENTION

This invention concerns a device and a method for selectively controlling flow path(s) of fluids between a well and surrounding subsurface rocks. Said fluids flow via at least one filter, for example a sand screen, arranged between the flow pipe and the surrounding rocks. Said at least one filter prevents solid particles from entering the well, and the filter hereinafter is denoted a sand screen only.

Preferably, the well is provided with a so-called open-hole completion, in which the flow pipe of the well is arranged in an open and uncased borehole. Alternatively, the well may be provided with cemented and perforated casings within which the flow pipe of the well is placed. Thus, said fluids flow via both said filter and perforations in the cemented casings.

Preferably, the present invention is used in connection with petroleum recovery and preferably in connection with production of reservoir fluids, including crude oil and/or gas. Moreover, the invention may be utilized in connection with fluid injection, including water injection and/or gas injection, into said subsurface rocks. The invention is particularly useful in connection with horizontal wells and highly deviated wells.

BACKGROUND OF THE INVENTION

The invention bears on the fact that often, particularly in open-hole-completed, sand-screen-provided wells, it is difficult to selectively determine, hence control, the fluid flow paths between the flow pipe of the well and the surrounding rock zones.

This type of control of the fluid flow paths is particularly useful when the flow pipe of the well penetrates rocks of dissimilar flow properties, for example rock zones of dissimilar permeability. In a vertical well, such rock zones may consist of layered rocks. In a horizontal well, lateral variations in the flow properties of the rocks may also exist. Moreover, such variations may exist even when the horizontal portion of the well penetrates one rock type only.

Under such conditions, frequently there is little or no pressure- and fluid communication between adjacent rocks having dissimilar flow properties. Among other things, this may cause uneven fluid drainage of, possibly fluid injection into, said rocks, leading to further known technical disadvantages and problems related to the well, the reservoir and/or the production.

In connection with, for example, petroleum production from a reservoir having zoned rocks of said type(s), it therefore is desirable to undertake successive drainage of individual production zones. Producing as much as possible oil and/or gas from a first reservoir zone, allows this to be carried out. In practice, the production is maintained until the formation water content (water cut) of the outflow assumes a certain maximum limit, after which the first reservoir zone is shut off. The same steps then are carried out for a second reservoir zone, etc.

Prior Art and Disadvantages Thereof

Prior art techniques comprise open-hole-completed petroleum production wells, the flow pipes (production tubing) of which are arranged with isolation means that temporarily shut off and, among other things, protect the wall openings of the production tubing until it is placed in the correct position in the borehole. Thereby, the inside of the production tubing is isolated from external influences while running it into the well. Then, the isolation means is removed, thereby allowing reservoir fluids to flow into the production tubing and onwards to surface. In this context, the following patent publications are mentioned: U.S. Pat. No. 5,355,956, U.S. Pat. No. 5,957,205 and U.S. Pat. No. 5,526,881.

U.S. Pat. No. 5,355,956 concerns a production tubing provided with radial flow apertures and an external sand screen surrounding the flow apertures. Said flow apertures may be provided with plugs made of a soluble material, for example zinc, aluminium or magnesium. Pumping a liquid dissolvent, for example an acid or a base, after placing the production tubing in the well, dissolves the plugs, and the flow apertures are opened to fluid inflow. Moreover, the plugs may be arranged in a manner allowing them to protrude radially into the tubing, upon which they are removed mechanically by means of prior art well intervention methods. Instead of placing said soluble plugs in the production tubing, soluble plugs may be placed within radial flow apertures in a tubular jacket on the outside of the production tubing and its sand screen.

U.S. Pat. No. 5,957,205 also pertain to a production tubing provided with radial flow apertures and an external sand screen. Prior to installation in the well, the flow volume between the production tubing and the sand screen is filled with a temporary sealing agent, for example wax, asphalt or tar, which hardens and seals said flow volume during insertion and installation of the production tubing in the well. Then, by pumping down a sealing-agent-dissolving means, for example hot steam, the sealing agent is liquefied and flows out of the flow volume, upon which the flow apertures are open to fluid inflow.

Similar to that of U.S. Pat. No. 5,355,956, U.S. Pat. No. 5,526,881 also describes a production tubing provided with radial flow apertures within which soluble metal plugs are placed, the plugs subsequently disintegrating by means of a liquid dissolvent, for example an acid or a base, being pumped down to these and opening to fluid inflow. However, the production tubing according to U.S. Pat. No. 5,526,881 is not provided with a sand screen.

A substantial disadvantage of all the above-mentioned, prior art isolation solutions is that it is difficult or impossible to selectively open one or several specific flow apertures in the flow pipe at different moments of time. Thus, it is difficult or impossible to selectively determine, hence control, the fluid flow paths between the flow pipe of the well and the surrounding rock zones during a recovery period or injection period. In practice, all flow apertures are usually opened simultaneously opposite adjacent rock zones, whereas other rock zones along the flow pipe remain isolated with respect to fluid flow. This may easily result in an unfavourable pressure- and flow pattern in the well and/or in the surrounding rocks. Prior art isolation solutions therefore exhibit a relatively small operational flexibility. Any re-completion or opening of one or several of said other rock zones at a later point in time usually will require a relatively complex, comprehensive and expensive intervention operation.

Also, the above-mentioned, prior art metal plugs or sealing agent will not withstand large pressure differentials that may exist between the inside and outside of the flow pipe, whereby they unintentionally may burst and disintegrate.

Objects of the Invention

The primary object of the invention is to avoid or reduce the above-mentioned disadvantages of prior art. The specific object of the invention is to render possible, during a period of time, selective control of fluid flow paths between a flow pipe of a sand-screen-provided well and surrounding rocks. Thus, and by means of separate well intervention, inflow or outflow positions along the flow pipe may be opened or shut off selectively and timely, thereby achieving optimum flow paths into or out of the well.

A particular object is to avoid or reduce the above-mentioned disadvantages in an open-hole-completed well.

How to Achieve the Objects

Said objects are achieved through features disclosed in the following description and in subsequent claims.

At least one longitudinal portion of said flow pipe is provided with an external, flow-through sand screen of suitable length, the flow pipe consisting of several interconnected base pipes constituting a pipe string extending to the surface of the well. In position of use, the outside of the sand screen faces outward towards a borehole, for example an uncased borehole, and it is placed in a suitable well position to achieve fluid communication with the desired rock zone. The filter medium of the sand screen is connected in a flow-through manner to the flow pipe via a flow channel. The filter medium is comprised of, for example, wire windings wound at a small internal axial distance on the outside of peripherally distributed axial lists/strips on the flow pipe, in which case said flow channel is divided into several axial channel segments by said lists. In prior art sand screens the flow pipe wall inside of said flow channel is provided with flow apertures, usually bores, prior to inserting and installing the flow pipe in the well.

According to a first aspect of the invention, and contrary to such prior art sand screens, the flow pipe wall is imperforated inside of and vis-à-vis the sand screen when installing the flow pipe in the well. As such, the pipe wall inside of said flow channel is not perforated or provided with flow apertures when inserting and installing the flow pipe in the well. According to the invention, the pipe wall is perforated inside of said flow channel after first having installed the flow pipe in the well, and in association with a separate well intervention. The perforation operation is carried out by means of a perforation tool, for example a perforation gun of known type, which is lowered into the well by means of a cable, coiled tubing or drill pipe. Preferably, the perforation is executed by means of custom-made explosive charges, so-called shaped charges, which provide blast holes of desired shape using an adapted explosive force. Damage to the external filter medium (particle filter) thus may be avoided. In order to avoid such damage, custom-adapted materials also may be utilized in the perforation region of the flow pipe and/or in the filter medium. Moreover, the filter medium may be placed at a somewhat larger distance from the flow pipe than what otherwise would be common for prior art sand screens.

According to a second aspect of the invention, said sand screen is axially connected in a flow-through manner to a sleeve placed between the flow pipe and the sand screen. The sleeve is placed at a radial distance from the flow pipe and on its outside. At its opposite, axial end portion, the sleeve is pressure-sealingly connected to the flow pipe. In this case, both the sleeve and the sand screen define the outside of said flow channel between the sand screen and the flow pipe, whereas the flow pipe defines the inside of the flow channel. Prior to installing the flow pipe in the well, the flow channel is closed toward the flow pipe by means of the flow pipe being imperforated inside of the channel. According to the invention, the flow pipe is perforated after first having installed the flow pipe in the well, and according to this aspect of the invention, the pipe wall vis-à-vis said sleeve is perforated. For example, the perforation is carried out in a manner disclosed according to the above-mentioned, first aspect of the invention. Said sleeve is of a shape and/or is made from custom-adapted materials preventing perforation through the wall of the sleeve. After perforation of this flow pipe wall, said flow channel is open to throughput and may conduct fluids, via the sand screen, between the flow pipe and surrounding rocks. Such a flow path is achieved only if the sleeve wall is not perforated during said perforation operation. During fluid production from the rocks, the sleeve will be placed downstream of the sand screen. During fluid injection into the rocks, however, the sleeve will be placed upstream of the sand screen.

The position of a region of the flow pipe to be perforated at a subsequent occasion may be localized in various ways. For example, the position of the region within the pipe string may be recorded relative to a reference point, usually the upper end portion of the pipe string. Having placed the flow pipe in position of use within the well, said region for perforation is localized through measuring from the reference point. Due to the pipe string being subjected to tensile extension while in position of use, however, this method may be too inaccurate for this purpose.

The at least one flow pipe region to be perforated subsequently, preferably is identified by means of a signal-transmitting mark, for example an insert or a chip, attached at a suitable place in or near the relevant perforation region(s) prior to installing the flow pipe in the well. The mark may consist of a radioactive chip or insert placed along the base pipe of the sand screen, for example in the sand screen, in the said sand-screen-connected sleeve, or in the base pipe connection socket. In the subsequent perforation operation, a prior art logging tool recording radioactive emission, may be utilized together with the perforation tool in order to localize the perforation region in the pipe wall.

By using a flow pipe being imperforated when installed in the well, and being provided with several sand screens and possible associated sleeve according to this invention, one or several sand-screen-connected pipe wall portions may be perforated selectively and at different times during a time period. In connection with such subsequent well interventions, fluid flow through at least one pipe wall portion of the flow pipe may also be shut off, for example by means of a shut-off plug/bridge plug internally in the flow pipe. Then at least one new sand-screen-connected pipe wall portion of the flow pipe may be perforated and arranged for fluid flow therethrough.

Thus, the fluid flow paths between the well and surrounding rocks may be controlled selectively and timely. The performance and utilization of the well and the rocks surrounding it thus is improved appreciably. In connection with installation of the flow pipe in the well, also external pipe packers of known types are utilized to isolate such sand screens and associated rock zones from other sand screens and rock zones.

In horizontal wells and highly deviated wells, such an imperforated and sand-screen-provided flow pipe provides a further advantage. In such wells, it may be problematic to introduce a common pre-perforated flow pipe into the horizontal or highly deviated section of the well, mostly due to friction between the borehole and the flow pipe. However, when the flow pipe is imperforated, and its lower end portion is blinded off, the flow pipe may be filled with a suitable fluid, for example nitrogen gas, providing the pipe with a buoyancy effect, which reduces said friction. Then the pipe may be floated onwards to a desired well depth, upon which said fluid is released from the pipe.

SHORT DESCRIPTION OF THE DRAWINGS

Figure 2:
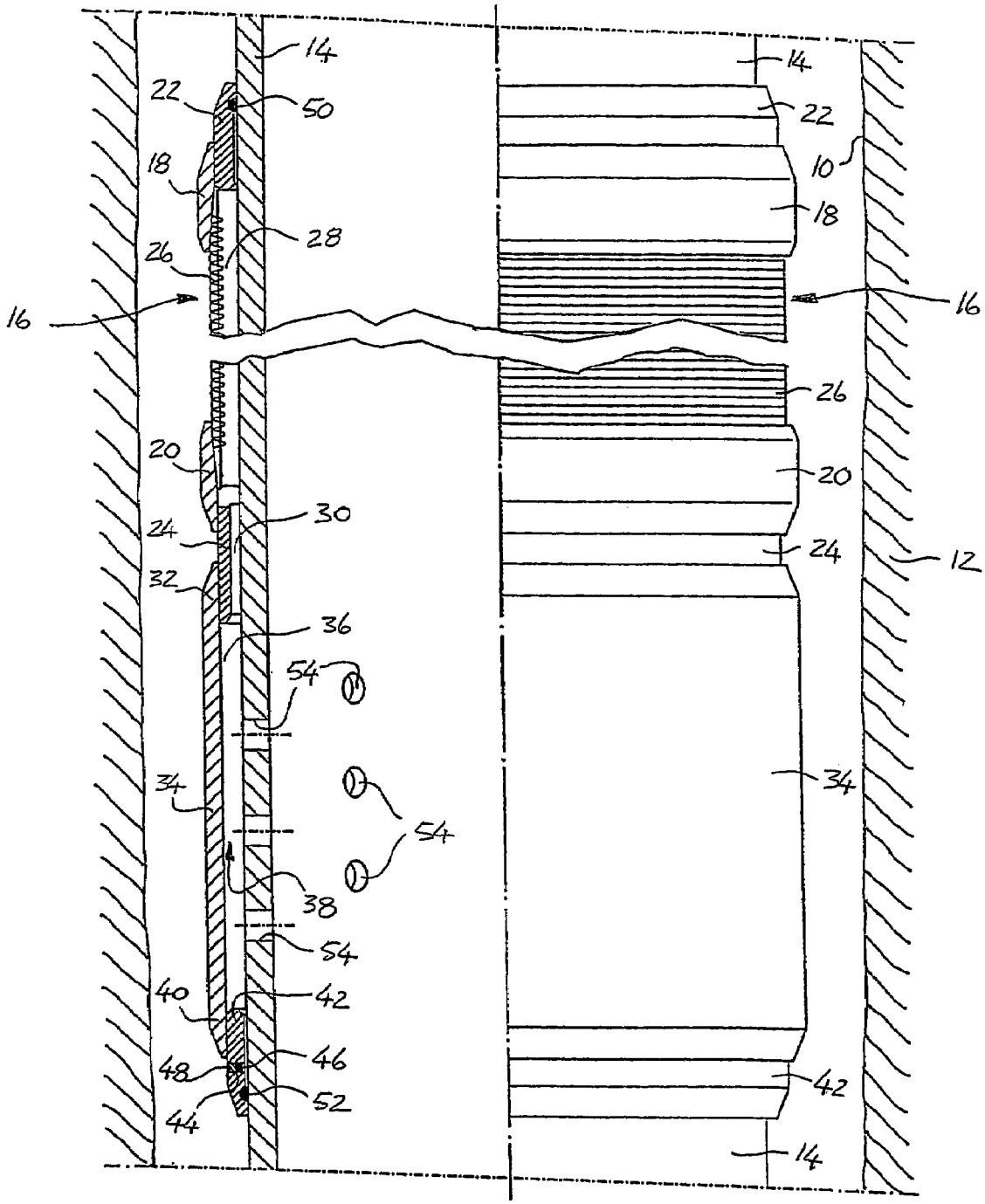

FIG. 1 shows a schematic and part section through a production tubing of an uncased well, in which the production tubing is provided with a sand screen and an axially connected sleeve, and in which the figure shows the production tubing in an imperforated state; and FIG. 2 shows the same as FIG. 1, except this figure shows the production tubing in a perforated state, in which the pipe wall inside of the sleeve is perforated, thereby allowing fluids to flow from adjacent rocks via the sand screen and the sleeve and into the production tubing. Alternatively, the fluids may flow in the opposite direction.

Moreover, the components of the figures are shown simplified and distorted regarding relative sizes, lengths, transverse dimensions, etc.

DESCRIPTION OF AN EXAMPLE OF AN EMBODIMENT OF THE INVENTION

FIG. 1 shows a section of a horizontal portion of an uncased borehole 10 of a production well, in which said horizontal portion penetrates a reservoir rock 12. The figure shows a base pipe 14 of the production tubing of the well, the production tubing being placed in the borehole 10 and extending up to the surface.

At least one base pipe 14 of the production tubing is provided with an external sand screen 16 affixed, by means of outer shrink rings 18, 20, on the outside of an inner shrink ring 22 and a connection ring 24, respectively, both of which are connected to the base pipe 14. Only the end portions of the sand screen 16 are shown in the figures.

The filter medium in the sand screen 16 consists of wire windings 26 wound on the outside of axial lists (not shown) on the base pipe 14, a ring-shaped filter chamber 28 thereby existing between the windings 26 and the pipe 14.

The connection ring 24 is provided with an inner, ring-shaped passage 30 being open to axial throughput. An end portion 32 of an axial sleeve 34 is connected on the outside of the connection ring 24, the connection ring 24 thus connecting the sleeve 34 and the sand screen 16. Thereby, a ring-shaped sleeve chamber 36 exists between the sleeve 34 and the base pipe 14. Together with said passage 30 in the connection ring 24, the filter chamber 28 and the sleeve chamber 36 form a flow channel 38.

The opposite end portion 40 of the sleeve 34 is connected on the outside of an inner shrink ring 42. The shrink ring 42 is provided with a radial bore 44 within which a radioactive insert 46 is placed, which is maintained therein by means of a securing screw 48. The inner shrink ring 42 and also said inner shrink ring 22 each is provided with its own internal ring gasket 50, 52, respectively, sealing against the base pipe 14.

According to the present invention, the flow pipe wall, in this case the production tubing wall, is imperforated inside of the sleeve chambers 36 upon installation of the flow pipe in the borehole 10, cf. FIG. 1.

FIG. 2 shows the base pipe 14 after being perforated by means of a perforation gun (not shown), which has been lowered into the well by means of a cable together with a logging tool (not shown) capable of recording radioactive emission from said radioactive inserts 46. By means of the logging tool, and prior to carrying out perforation of the base pipe 14, the position of the insert 46 in the pipe 14 is recorded. Based on this information, the perforation gun then is placed in correct position directly opposite the sleeve chamber 36, whereupon the wall of the base pipe 14 is perforated. FIG. 2 shows perforation apertures 54 through the base pipe 14 and into the sleeve chamber 36. Thereby, said flow channel 38 is made accessible to reservoir fluids that may flow therethrough from the rock 12 and into the production tubing. Alternatively, the flow channel 38 may be used for injection of fluids into the rock 12.

The invention claimed is:

1. A device for selective control of fluid flow between a flow pipe of a well and surrounding rocks in a borehole, in which the flow pipe is provided with at least one flow-through particle filter placed externally on the flow pipe and between the flow pipe and the rocks, and in which said filter is connected in a flow-through manner to the flow pipe via a flow channel, characterized in that the flow pipe is provided with an imperforated pipe wall inside of and vis-à-vis said flow channel when installing the flow pipe in the well, after which the flow pipe may be perforated selectively inside of said flow channel for one or several filters along the flow pipe, whereupon fluids may flow through the flow channel and the filter via perforation apertures in the flow pipe.

2. The device according to claim 1, characterized in that the at least one particle filter is axially connected to an end portion of a sleeve placed at a radial distance outside of the flow pipe and between the flow pipe and the particle filter, and wherein the other end portion of the sleeve is pressure-sealingly connected to the flow pipe, whereby both the sleeve and the particle filter define the outside of said flow channel, whereas the flow pipe defines the inside thereof whereupon the flow pipe may be perforated selectively vis-à-vis the sleeve.

3. The device according to claim 1, characterized in that the flow pipe is provided with a signal-transmitting mark in or near a region of the flow pipe to be perforated subsequently, whereby said perforation region may be identified prior to perforation.

4. The device according to claim 3, characterized in that the signal-transmitting mark is a radioactive chip or insert.

5. The device according to claim 2, characterized in that the flow pipe is provided with a signal-transmitting mark in or near a region of the flow pipe to be perforated subsequently, whereby said perforation region may be identified prior to perforation.

6. A method for selective control of fluid flow between a flow pipe of a well and surrounding rocks in a borehole, in which the flow pipe is provided with at least one flow-through particle filter placed externally on the flow pipe and between the flow pipe and the rocks, and in which said filter is connected in a flow-though manner to the flow pipe via a flow channel, characterized in:

(a) providing the flow pipe with an imperforated pipe wall inside of and vis-à-vis said flow channel prior to installing the flow pipe in the well; and (b) then, after being installed in the well, selectively perforating the flow pipe inside of said flow channel for one or several filters along the flow pipe, whereupon fluids may flow through the flow channel and the filter via perforation apertures in the flow pipe.

7. The method according to claim 6, characterized in:

axially connecting, in step (a), the at least one particle filter to an end portion of a sleeve being placed at a radial distance outside of the flow pipe and between the flow pipe and the particle filter, the other end portion of the sleeve being pressure-sealingly connected to the flow pipe, whereby both the sleeve and the particle filter define the outside of said flow channel, whereas the flow pipe defines the inside thereof; and then, in step (b), selectively perforating the flow pipe vis-à-vis the sleeve.

8. The method according to claim 7, characterized in providing the flow pipe, prior to being installed in the well, with a signal-transmitting mark in or near a region of the flow pipe to be perforated subsequently, whereby said perforation region may be identified prior to perforation.

9. The method according to claim 8, characterized in providing the flow pipe with a radioactive chip or insert.

10. The method according to claim 7, characterized in providing the flow pipe, prior to being installed in the well, with a signal-transmitting mark in or near a region of the flow pipe to be perforated subsequently, whereby said perforation region may be identified prior to perforation.

* * * * *